US012357034B2

(12) United States Patent
Pan et al.

(10) Patent No.: US 12,357,034 B2
(45) Date of Patent: Jul. 15, 2025

(54) NON-IGNITING, NON-ELECTRIC CIGARETTE SIMULATOR THAT ELIMINATES NICOTINE FROM USER'S BODY

(71) Applicants: Tsung-Yu Pan, Ypsilanti, MI (US); Frank Winterroth, Mountain View, CA (US); Chun Liu, Ypsilanti, MI (US)

(72) Inventors: Tsung-Yu Pan, Ypsilanti, MI (US); Frank Winterroth, Mountain View, CA (US); Chun Liu, Ypsilanti, MI (US)

( * ) Notice: Subject to any disclaimer, the term of this patent is extended or adjusted under 35 U.S.C. 154(b) by 0 days.

(21) Appl. No.: 15/925,415

(22) Filed: Mar. 19, 2018

(65) Prior Publication Data

US 2021/0100290 A1 Apr. 8, 2021

(51) Int. Cl.
*A24F 42/20* (2020.01)
*A24F 42/60* (2020.01)

(52) U.S. Cl.
CPC ..... *A24F 42/20* (2020.01); *A24F 42/60* (2020.01)

(58) Field of Classification Search
CPC ..... A24F 42/60; A24F 42/20; B05B 11/0054
See application file for complete search history.

(56) References Cited

U.S. PATENT DOCUMENTS 3,320,953 A 5/1967 Ridner
1,169,637 A 11/1969 Broadley
3,521,643 A 7/1970 Toth
(Continued)

FOREIGN PATENT DOCUMENTS

CN 104161303 11/2014
CN 204653768 9/2015
(Continued)

*Primary Examiner* — Michael H. Wilson
*Assistant Examiner* — Jennifer A Kessie
(74) *Attorney, Agent, or Firm* — Michael A. Blake

(57) ABSTRACT

In one embodiment of the present disclosure, the simulator apparatus a disposable, replaceable filter cartridge insertable into a recessed cavity of the main tubing in the interior chamber of a distal end of the cylindrical body, wherein the disposable cartridge comprises a base, spinach, ginger, cranberry extracts, carrot, pomegranate, citrus extract, broccoli, wheat germ and kale; and, a removably attachable coupling securing the filter cartridge in place at the distal end of the cylindrical body to lock the filter cartridge into the recessed cavity of the main tubing. In one embodiment, the apparatus further comprises a removably attachable cover, wherein the cover comprises a grid. In another embodiment the removably attachable cover comprises a screen. In yet another embodiment of the present disclosure, the removably attachable coupling further comprises one or more piston handles connected to the filter cartridge; and one or more hooks attached to the one or more piston handles removably coupled to an outer lip of cylindrical body of the simulator apparatus; and, one or more hooks located symmetrically around a radius at one or more same positions on the outer lip of the cylindrical body of the simulator apparatus, wherein the one or more hooks are configured to open and close through applying mechanical tension.

9 Claims, 11 Drawing Sheets

(56) References Cited

U.S. PATENT DOCUMENTS

| | | | | |
|---|---|---|---|---|
| 4,393,884 | A * | 7/1983 | Jacobs | A61M 15/0093 131/273 |
| 4,429,703 | A | 2/1984 | Haber | |
| 4,807,648 | A | 2/1989 | Breckwoldt | |
| 4,995,407 | A | 2/1991 | Kossiakoff | |
| 6,178,969 | B1 | 1/2001 | St. Charles | |
| 2006/0130857 | A1 * | 6/2006 | Roth | A24F 42/60 131/273 |
| 2010/0200006 | A1 * | 8/2010 | Robinson | A24D 1/20 131/194 |
| 2012/0067358 | A1 | 3/2012 | Rash | |
| 2012/0090629 | A1 * | 4/2012 | Turner | A61M 15/06 131/273 |
| 2013/0014755 | A1 * | 1/2013 | Kumar | A24F 42/10 128/202.21 |
| 2014/0261483 | A1 * | 9/2014 | Hopps | A24B 15/26 131/297 |
| 2014/0271791 | A1 * | 9/2014 | Mishra | A61K 31/522 424/443 |
| 2018/0093067 | A1 * | 4/2018 | Moll Neto | A61M 15/08 |

FOREIGN PATENT DOCUMENTS

| | | |
|---|---|---|
| WO | 039302 | 2/2005 |
| WO | 2005009152 | 2/2005 |
| WO | 2011039302 | 4/2011 |
| WO | 2012005439 | 1/2012 |

* cited by examiner

NON-IGNITING, NON-ELECTRIC CIGARETTE SIMULATOR THAT ELIMINATES NICOTINE FROM USER'S BODY

FIELD

The present disclosure relates generally to a non-electric, non-igniting cigarette simulator. More specifically, the present disclosure relates to a non-electric, non-igniting cigarette simulator that helps reduce the cravings for cigarettes and eliminates toxins from the body.

BACKGROUND

Smoking is a prevalent and consequently deadly habit, leading to addiction and subsequent diseases and death. Poverty, lack of education, and cheap and easy access to tobacco, products are leading to significantly high rates of smokers within poorer, less developed regions.

In numerous developed and developing countries regions, smoking is a prevalent and consequently deadly habit, leading to addiction and subsequent diseases and death. Lack of education in these regions coupled with cheap and easy access to tobacco products—along with a relentless advertising campaign by the tobacco industries—has resulted in a high rate of smokers in these countries The Center for Disease Control reports global excise taxes on tobacco exceeds $130 billion annually, but less than $1 billion is spent on global tobacco control. The high cost of treating smoking-related problems will potentially soar, currently approximately $500 billion is spent on medical intervention, productivity losses, and smoking related fire damage. It is therefore imperative to curb these aforementioned statistics through smoking cessation apparatuses and methods.

The market for smoking cessation products n developed and developing countries is extremely small, and the causes for this include the limited products available on the market. In addition, the price of most cigarette substitutes is higher than the price of cigarettes themselves or requires a prescription. Currently, there are only a few types of smoking cessation products, for example; an electronic cigarette which is significantly more expensive than actual cigarettes, a nicotine patch, and a smoking cessation pill. These products are typically cost-prohibitive and ultimately ineffectual there since the users are not properly provided with the motives to use them. Many smokers—especially those in poorer regions—are uneducated on the dangers of cigarettes; hence have no incentives to quit. It is evident that the market for smoking cessation products and services in developing countries is minimal and yet to be fully developed.

Current programs to curb or eliminate smoking in developing countries are either non-existent or unenforced as the public is less informed of its health effects and their government is reluctant to intervene as tobacco has high revenues: global excise taxes on tobacco exceeds $130 billion annually.

The high cost of treating smoking-related problems will potentially rise, for example, over $500 billion is spent on medical intervention, productivity losses, and smoking-related fire damage. This figure is certain to increase significantly in 5-10 years as the growing health effects from smoking will be incurred on the populace.

Hence, what is needed is a low-cost cigarette substitute that simulates the effects of smoking to support a user trying to quit nicotine usage. What is also needed is low-cost cigarette substitute that simulates the effects of smoking including natural materials known to reduce to reduce nicotine levels in the body. In the present disclosure, using the simulator apparatus and method, nicotine is replaced with a combination of menthol and all natural chemical surrogates which can be inhaled in aerosol form but does not have the same deleterious effects as cigarettes nor damage the ciliated lining of the pulmonary tract. In addition, the all-natural chemical surrogates help eliminate nicotine from the body and purify a user's system.

SUMMARY

In accordance with the teachings provided herein apparatuses and methods are provided for a smoking cessation apparatus and method. Specifically an apparatus is described comprising a non-igniting cigarette simulator. In one embodiment of the present disclosure, the simulator apparatus has a cylindrical body which may be tapered at a proximal inhalation end. The simulator apparatus has substantially cylindrical body and an interior chamber and a main tubing which traverses the entire length of the cylindrical body. A disposable, replaceable filter cartridge is insertable into a recessed cavity of the main tubing in the interior chamber of the distal end of the cylindrical body. The disposable cartridge may comprise a base, spinach, ginger, cranberry extracts, carrot, pomegranate, citrus extract, broccoli, wheat germ and kale. In an embodiment, a clip mechanism secures a cover in place at the distal end of the cylindrical body to secure the disposable, replaceable filter cartridge in place.

In one embodiment of the present disclosure, the simulator apparatus has substantially cylindrical body having the approximate length of 8.0-12.0 cm, which is tapered at a proximal inhalation end, wherein the interior chamber of the cylindrical body has an interior cavity area 3.0-4.0 mm in diameter which traverses the entire length of the cylindrical body. In one aspect of the invention, the cylindrical body having the approximate length of 9.5-11.5 cm in length. In another aspect of the invention, the interior chamber of the cylindrical body may be between 2.5-4.3 mm in diameter. In another aspect of the embodiment, the cylindrical body of the simulator apparatus is comprised of Bisphenol A (BPA)-free polymer.

In another embodiment, a cylindrical body, tapered at a proximal inhalation end, wherein the cylindrical body has an interior chamber and a main tubing which traverses the entire length of the cylindrical body;

In one embodiment of the present disclosure, the simulator apparatus a disposable, replaceable filter cartridge insertable into a recessed cavity of the main tubing in the interior chamber of a distal end of the cylindrical body, wherein the disposable cartridge comprises a base, spinach, ginger, cranberry extracts, carrot, pomegranate, citrus extract, broccoli, wheat germ and kale; and, a removably attachable coupling securing the filter cartridge in place at the distal end of the cylindrical body to lock the filter cartridge into the recessed cavity of the main tubing. In one embodiment, the apparatus further comprises a removably attachable cover, wherein the cover comprises a grid. In another embodiment the removably attachable cover comprises a screen.

In yet another embodiment of the present disclosure, the removably attachable coupling further comprises one or more piston handles connected to the filter cartridge; and one or more hooks attached to the one or more piston handles removably coupled to an outer lip of cylindrical body of the simulator apparatus; and, one or more hooks located symmetrically around a radius at one or more same positions on the outer lip of the cylindrical body of the simulator apparatus, wherein the one or more hooks are configured to open and close through applying mechanical tension.

In yet another embodiment of the present disclosure, the disposable filter base further comprises a highly concentrated menthol compound. In another embodiment, the disposable filter base further comprises a highly concentrated menthol compound, extracts from licorice, red clover, fava bean and turmeric. In yet another embodiment of the present disclosure, the simulator's cylindrical body is comprised of Bisphenol A (BPA)-free polymer.

In another embodiment, wherein the disposable, replaceable filter cartridge is comprises a plastic shell of poly-dimethyl sulfate (PDMS). In another embodiment, wherein the disposable, replaceable filter is comprised of a vegetable-based gelatin, laminated film with a multilayer barrier and a fenestrated permeable membrane. In another embodiment, the simulator body further comprises one or more air vents on one or more adjacent sides of the cylindrical body allowing for air diffusion through one or more sides of the cylindrical body to the interior chamber, wherein the air vents increase the air flow when the simulator is in use and dilute vapor concentration from the cartridge.

In yet another embodiment of the present disclosure, a non-igniting, non-electric cigarette simulator apparatus is disclosed. The simulator apparatus comprises a cylindrical body, wherein the cylindrical body has an interior chamber and a main tubing which traverses the entire length of the cylindrical body; a disposable, replaceable filter cartridge insertable into a recessed cavity of the main tubing in the interior chamber of a distal end of the cylindrical body; a cover, wherein the cover is attached to the filter cartridge and coupled to a removably attachable coupling mechanism securing the filter cartridge in place in the recessed cavity of the main tubing at the distal end of the cylindrical body. In another embodiment, the removably attachable coupling mechanism comprises securing the filter cartridge onto the simulator apparatus with a threaded lock. In yet another embodiment, the removably attachable coupling mechanism comprises securing the filter cartridge onto the simulator apparatus with a clip.

In another embodiment, the disposable, replaceable filter cartridge further comprises a base, spinach, ginger, cranberry extracts, carrot, pomegranate, citrus extract, broccoli, wheat germ and kale. In another embodiment, disposable filter base further comprises a highly concentrated menthol compound.

In another embodiment, the simulator device has one or more air vents on one or more adjacent sides of the cylindrical body allowing for air diffusion through one, or more sides of the cylindrical body to the interior chamber, wherein the air vents increase the air flow when the simulator is in use and dilute vapor concentration from the cartridge.

A further embodiment of the present embodiment discloses a method for using a non-igniting, non-electric cigarette simulator apparatus. The method comprising: providing the simulator apparatus wherein the simulator apparatus further comprises; a cylindrical body tapered slightly at the proximal inhalation end, wherein the interior of the cylindrical body has an interior chamber and a main tubing configured to traverse the entire length of the cylindrical body; inserting a disposable, replaceable filter cartridge into a distal end of a recessed cavity of the main tubing of the interior chamber, wherein the disposable cartridge comprises a contents including a base, spinach, ginger, cranberry extracts, carrot, pomegranate, citrus extract, broccoli, wheat germ and kale; securing the filter cartridge a in place at the distal end of the cylindrical body via a removable attachment mechanism to removably couple the filter cartridge into recessed cavity of main tubing; and, diffusing air though the distal end of the simulator apparatus through the contents of the disposable cartridge apparatus allowing for air dispersal into the main tubing of the interior chamber to the proximal end of the simulator apparatus when in use by a user of the simulator apparatus.

In an embodiment of the present disclosure, the method further comprises coupling a removably attachable cover to the simulator body, wherein the cover comprises a grid. In an embodiment of the present disclosure the method comprises coupling a removably attachable cover to the simulator body, wherein the cover comprises a screen. In an embodiment of the present disclosure, the method comprises securing the cover onto the simulator apparatus with a clip. In an embodiment of the present disclosure, the cover comprises a screen. In an embodiment of the present disclosure, securing the cover onto the simulator apparatus with a clip. In an embodiment of the present disclosure, securing the cover onto the simulator apparatus with a threaded cover.

In an embodiment of the present disclosure the removably attachable coupling mechanism further comprises: tethering one or more piston handles to the filter cartridge, wherein each one or more piston handles has a hook at the opposing end to the end attach to the filter cartridge: and removably attaching one or more clips attached to an outer lip of cylindrical body of the simulator apparatus to one or more hooks on the one or more piston handles, locking the filter cartridge in place in the simulator device. In an embodiment of the present disclosure coupling the one or more one or more piston handles and one or more hooks located symmetrically around a radius of the filter cartridge to one or more clips located around a radius at one or more coordinated symmetrical positions on the outer lip of the cylindrical body of the simulator apparatus configured td open and close through applying mechanical tension.

In an embodiment of the present disclosure, further comprising forming the simulators disposable, replaceable filter cartridge plastic shell from poly-dimethyl sulfate (PDMS). The method further comprising forming the simulators disposable replaceable filter from a vegetable-based gelatin, laminated film with a multilayer barrier and a fenestrated permeable membrane.

In an embodiment of the present disclosure, further comprising composing the disposable filter base from a highly concentrated menthol compound. In an embodiment of the present disclosure, further comprising composing the disposable filter base from a highly concentrated menthol compound, extracts from licorice, red clover, fava bean and turmeric.

In an embodiment of the present disclosure, wherein the simulator body further comprises allowing for air diffusion through one or more air vents on one or more adjacent sides of the cylindrical body through to the interior chamber, wherein the air vents are configured to increase the air flow when the simulator is in use and dilute vapor concentration from the filter cartridge.

BRIEF DESCRIPTION OF THE FIGURES

The present invention is illustrated by way of example, and not by way of limitation, in the figures of the accompanying drawings and in which like reference numerals refer to similar elements and in which.

DETAILED DESCRIPTION

The following detailed description of embodiments f the invention makes reference to the accompanying drawings in which like references indicate similar elements, showing by way of illustration specific embodiments of practicing the invention. Description of these embodiments is in sufficient detail to enable those skilled in the art to practice the invention. One skilled in the art understands that other embodiments may be utilized and that logical, mechanical electrical, functional and other changes may be made without departing from the scope of the present invention. The following detailed description is, therefore, not to be taken in a limiting sense, and the scope of the present invention is defined only by the appended claims.

The present disclosure comprises a non-electronic, non-igniting simulator apparatus which does not produce nor release any toxic smoke, thus helping smokers wean off of cigarette use. In addition, this simulator apparatus contains a disposable, replaceable filter cartridge containing constituent components which have been proven to eliminate nicotine and other toxic products from smokers, helping them to further stop smoking. The simulator apparatus also fulfills an oral fixation which many smokers possess. Further, there may be smart phone application which complements the system, developing a customized smoking cessation program for each individual user.

The principal component of the present invention is a non-electronic, non-igniting and reusable simulator apparatus comprising a distal end, a cylindrical body, with a tapered proximal end. The interior of the simulator apparatus is hollow with a main tubing, approximately 3.0 mm in diameter in the center which traverses the entire body of the device from the proximal end to the distal end. The cylindrical body of the simulator apparatus has side vents past the disposable, replaceable filter cartridge which allow additional it to diffuse into the simulator apparatus through a side tubing which lead to the main tubing, diluting the vapors. The distal end of simulator apparatus contains a disposable, replaceable filter cartridge consisting of the constituent components. As the user inhales on the proximal end the vapors travel from the cartridge down the main tubing and are inhaled by the user The simulator apparatus thus, fulfills an oral fixation and helps to eliminate nicotine and other toxic products from a users body.

Figure 1:
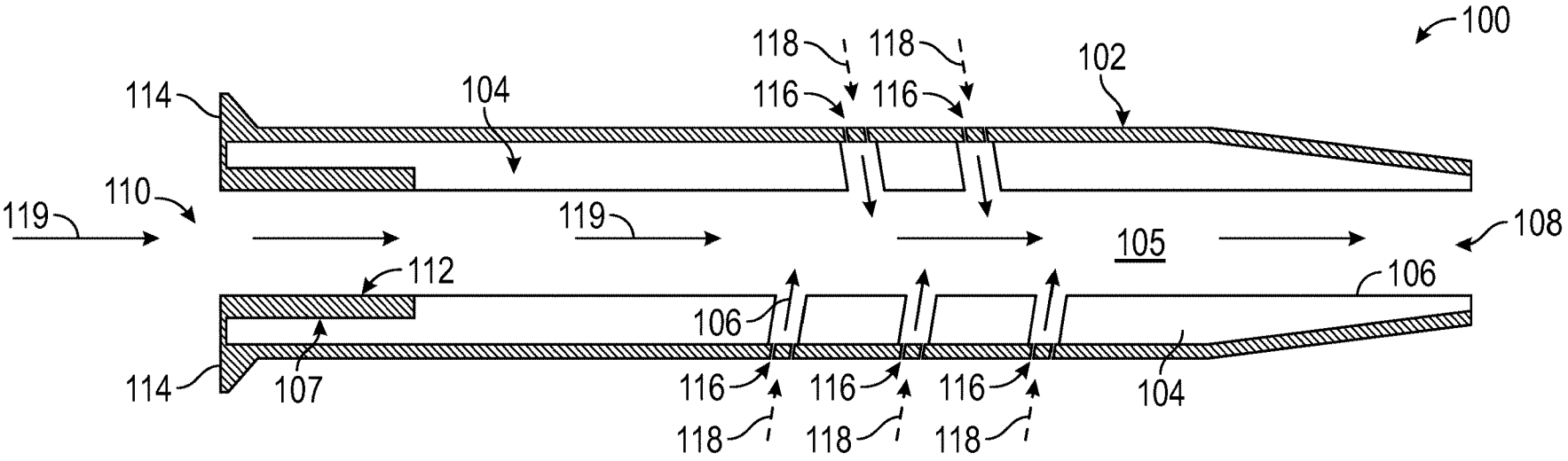
FIG. 1 is a block diagram of an illustrative embodiment of a cross-sectional side view of a non-electric, non-igniting cigarette simulator apparatus.

FIG. 1 is a block diagram of an illustrative embodiment of a cross-sectional side view of a non-electric, non-igniting cigarette simulator apparatus 100. The simulator apparatus 100 has a substantially cylindrical body 102 is comprised of a Bisphenol A (BPA)-free polymer and is approximately 8.0-12.0 cm in length and has a cylindrical casing 104 approximately 1.5-3.5 mm thick. In another embodiment, simulator apparatus 100 cylindrical body 102 is approximately 10.0-11.0 cm in length. In one embodiment, the simulator apparatus 100 comprises an interior chamber 105. In one embodiment of the present disclosure, the interior chamber 105 of the simulator apparatus 100 is comprised of a main tubing 106, approximately 2.5-4.0 mm in diameter which transverses the entire length of the simulator apparatus 100. In one embodiment, the main tubing 106 has a recessed cavity 107 at the distal end 110 to allow for disposable, replaceable filter cartridge 112 to be inserted.

In one embodiment of the present disclosure, the simulator apparatus 100 cylindrical body 102 is tapered at the proximal end 108. In yet another embodiment of the present disclosure, the distal end 110 of the interior chamber 105 of the simulator apparatus 100 cylindrical body comprises an recessed cavity 107 in, main tubing 106 for inserting and holding disposable, replaceable filter cartridge 112 In another aspect of the disclosure the distal end 110 of the interior chamber 106 of the main tubing 106 of the simulator apparatus 100 cylindrical body comprises an outer lip 114. Outer lip 114 and disposable, replaceable filter cartridge 112 will be discussed in greater detail below in reference to FIGS. 3, 4 and 5.

In another aspect of the disclosure, simulator apparatus 100 cylindrical body 102 comprises side vents 116 which allow air 118 to diffuse through cylindrical body 102 through to interior chamber 105 and main tubing 106 of the simulator apparatus 100. Side vents 116 are approximately 0.5-1.0 mm in diameter allowing additional air 118 to diffuse into the simulator apparatus 100 through cylindrical body 102, cylindrical casing 104, the main tubing 106 to interior chamber 105 of the simulator apparatus 100. These side vents 116 are located approximately 5.0-6.0 cm from the proximal end 108 of the simulator apparatus 100 and approximately 3.5-4.0 cm from the distal end 110 of the simulator apparatus 100 and the disposable, replaceable filter cartridge 112. Side vents 116 are designed to increase the air flow 118 (shown in detail in FIG. 6) to interior chamber 106 of the simulator apparatus 100 when it is in use by a user.

In one embodiment of the present disclosure, when in use, a user inhales on proximal end 108 of simulator apparatus 100, air flows 119 through distal end 110, passing through constituent components of disposable, replaceable filter cartridge 112. Air flows 110 through interior chamber 105 as additional air flows 118 through side vents 116 to interior chamber 105 through to the proximal end 108 wherein a the constituent components of filter cartridge 112 are inhaled by a user of simulator apparatus 100.

Side vents 116 allow for the vapors to be more gradually inhaled into the user's lungs, reducing the likelihood of any systemic irritation to the lungs from the vapor concentration in constituent components in the disposable, replaceable filter cartridge 112. The side vents 116 will be discussed in more detail in FIG. 6.

Figure 2A:
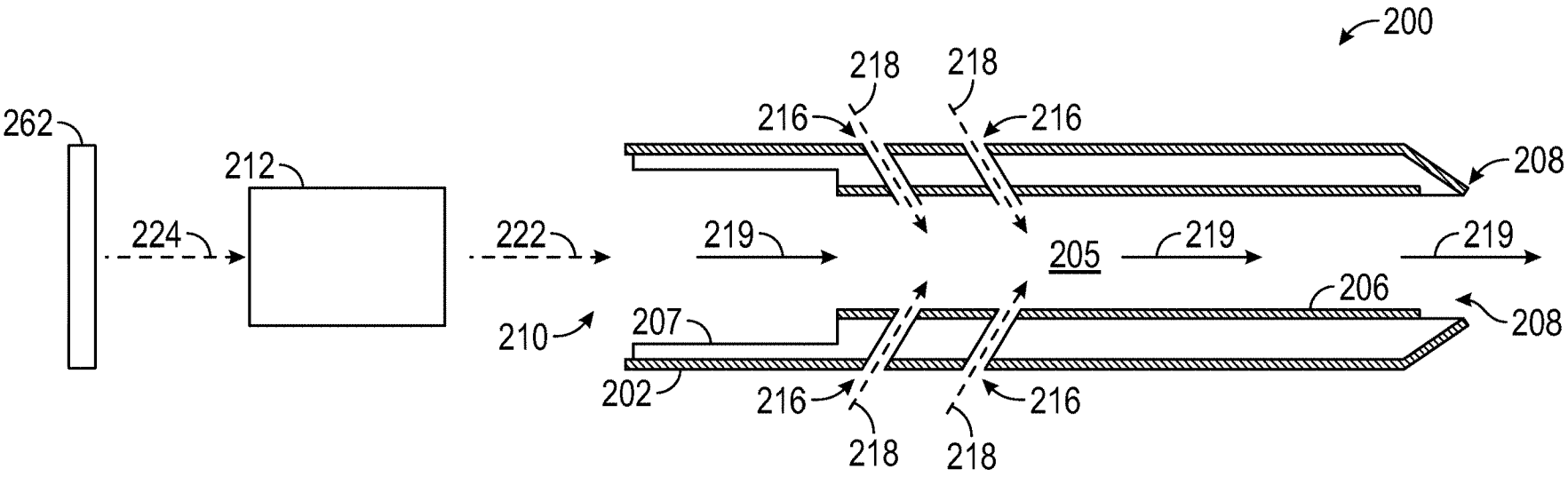
FIG. 2A is a block diagram of an illustrative embodiment of a cross-sectional side view of one embodiment illustrating the principal components of the non-electric, non-igniting cigarette simulator apparatus in which various embodiments of present disclosure may be implemented.

FIG. 2A is a block diagram of an illustrative embodiment of a cross-sectional side view of one embodiment illustrating the principal components of the non-electric, non-igniting cigarette simulator apparatus 200 in which various embodiments of present disclosure may be implemented. In one embodiment of the present disclosure, the cylindrical body 202 of simulator apparatus 200 is tapered at the proximal end 208 of the simulator apparatus 200. In one embodiment of the present disclosure, the distal end 210 of the interior chamber 205 of main tubing 206 of simulator apparatus 200 cylindrical body 202 comprises recessed cavity 207 in main tubing 206 for inserting a disposable, replaceable filter cartridge 212. In one embodiment the disposable, replaceable filter cartridge 212 may be 2.5-4.5 cm in length. In another embodiment, disposable, replaceable filter cartridge 212 may be 2.0-4.0 in length. In one embodiment, the disposable, replaceable filter cartridge 212 may have a length that is 2.0-4.0 cm which may be less than car equal to the length of the recessed cavity 207 of main tubing 206 at the distal end 210 of interior chamber 205 of cylindrical body 202 of simulator apparatus 200. In one embodiment, the length and width of the disposable, replaceable filter cartridge 212 may depend on the active constituent components of the cartridge, and benefits of size of the disposable, replaceable filter cartridge 212 verses use ratio of the active constituent components of filter cartridge 212.

In another embodiment the of the present disclosure, the filter cartridge 212 may have a diameter that is 2.0-1.0 mm less than the diameter of the recessed cavity 207 of the main tubing 206. In the one embodiment, the disposable, replaceable filter cartridge 212 may have a diameter that is 0.075-0.5 mm less than the diameter of the recessed cavity 207 of main tubing 106 at the distal end 210 of interior chamber 205 of cylindrical body 202 of simulator apparatus 200. In yet another embodiment, disposable, replaceable filter cartridge 212 may have a diameter that is 0.075-0.5 mm less than the diameter of recessed cavity 207 of main tubing 206 at the distal end 210 of interior chamber 205 of cylindrical body 202 of simulator apparatus 200. In another embodiment, disposable, replaceable filter cartridge 212 may have a diameter that is less than or equal to the diameter of recessed cavity 207 of main tubing 206 at the distal end 210 of interior chamber 205 of cylindrical body 202 of simulator apparatus 100. In one embodiment, the disposable, replaceable filter cartridge 212 may have a diameter that is less than or equal to the length of the recessed cavity 307 of main tubing 206 at the distal end 210 of interior chamber 205 of cylindrical body 202 of simulator apparatus 200.

As is illustrated in FIG. 2A by arrow 222, fitter cartridge 212 is inserted into the distal end 210 of the non-electric, non-igniting cigarette simulator apparatus 200 In one embodiment, as illustrated by arrow 224 cover 262 is removably attachable to distal end 210 of cylindrical body 202 of simulator apparatus of simulator apparatus 200.

Figure 2B:
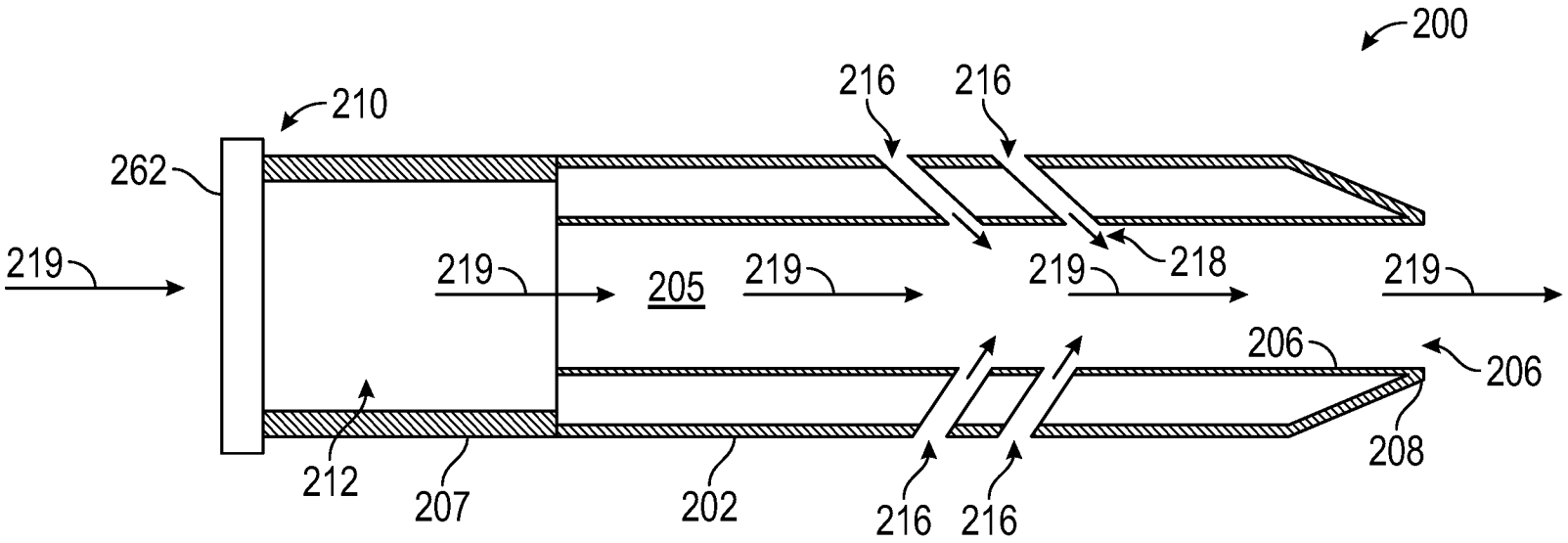
FIG. 2B is a block diagram of an illustrative embodiment of a cross-sectional view of one embodiment illustrating the principal components of the non-electric, non-igniting cigarette simulator apparatus in an operating mode in which various embodiments of present disclosure may be implemented.

FIG. 2B is a block diagram of an illustrative embodiment of a cross sectional view of one embodiment illustrating the principal components of the non-electric, non-igniting cigarette simulator apparatus 200 in an operating mode in which various embodiments of present disclosure may be implemented. In one embodiment of the present disclosure, the simulator apparatus 200 cylindrical body 202 is tapered at the proximal end 208. In an embodiment of the present disclosure, the distal end 210 of the interior chamber 205 of the main tubing 206 cylindrical body 202 comprises recessed cavity 207 for containing a disposable, replaceable filter cartridge 212.

In one embodiment, a removable attachment mechanism comprises a cover 262 which is removably attachable to distal end 210 of cylindrical body 202 of non-electric, non-igniting cigarette simulator apparatus 200 locking filter cartridge 212 into simulator apparatus 200. In one embodiment, the cover 262 removably attaches to distal end 210 of cylindrical body 202 of non-electric, non-igniting cigarette simulator apparatus 200 locking filter cartridge 212 in place in simulator apparatus 200. Several other embodiments of a removably attachable coupling mechanism will be discussed below in reference to FIGS. 3A, 3B, 3C, 3D, 4A, 4B 4C, 4D, 5A, 5B, and 5*c*.

As illustrated in FIG. 2B in one embodiment once disposable, replaceable filter cartridge 212 is inserted into recessed cavity 207 of main tubing 206 of interior chamber 205 of non-electric, non-igniting cigarette simulator apparatus 200 air flows 219 through the distal end 210 of interior chamber 205 of non-electric, non-igniting cigarette simulator apparatus 200 through disposable replaceable filter cartridge 212 and additional air flows 218 in via side vents 216 and finally out through the proximal end 208.

In one aspect of an embodiment of the disclosure a method is disclosed. The method comprises providing cigarette simulator apparatus 200. The simulator apparatus further comprises a cylindrical body 202 tapered slightly at the proximal inhalation end 208, wherein the interior of the cylindrical body 202 has an interior cylindrical chamber 205 and a main tubing 206 configured to traverse the entire length of the cylindrical body 202; inserting a disposable, replaceable filter cartridge 212 into a distal end 210 of a recessed cavity 207 of the main tubing 206 of the interior cylindrical chamber, wherein the disposable 212 cartridge comprises a contents including a base, spinach, ginger, cranberry extracts, carrot, pomegranate, citrus extract, broccoli, wheat germ and kale; securing a removably attachable cover 262 a in place at the distal end 210 of the cylindrical body 210; and diffusing air 219 though the distal end 210 of the simulator apparatus 210 through the contents of the disposable filter cartridge 212 allowing for air dispersal 219 into the main tubing 206 of the interior cylindrical chamber 205 to the proximal end 208 of the simulator apparatus 200 when in use by a user of the simulator apparatus 200.

Figure 3A:
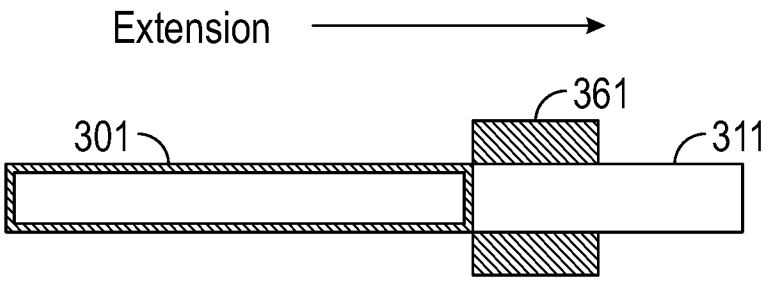
FIG. 3A is a block diagram of an illustrative embodiment of a cross-sectional side view of one embodiment showing a removably attachable coupling mechanism for a disposable, replaceable filter cartridge for a non-electric, non-igniting cigarette simulator apparatus in an extended view in which various embodiments of present disclosure may be implemented.
Figure 4C:
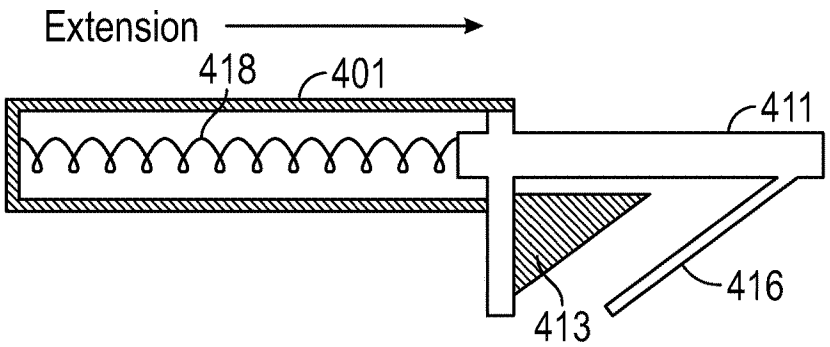
FIG. 4C is a block diagram of an illustrative embodiment of a cross sectional perspective view of one embodiment showing a disposable, replaceable filter cartridge and a removably attachable coupling mechanism for a non-electric, non-igniting cigarette simulator apparatus in an extended view in which various embodiments of present disclosure may be implemented.
Figure 4D:
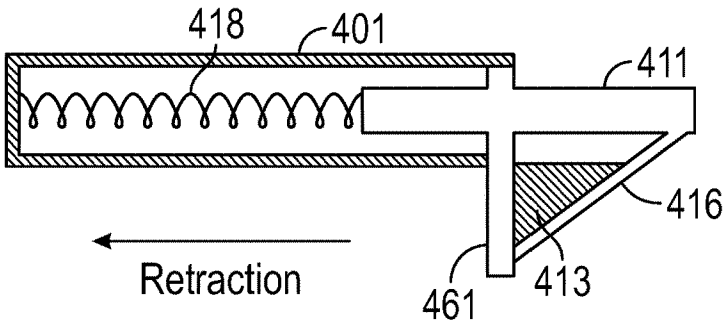
FIG. 4D is a block diagram of another illustrative embodiment of a cross-sectional perspective view of one embodiment further illustrating a disposable, replaceable filter cartridge and a removably attachable coupling mechanism for a non-electric, non-igniting cigarette simulator apparatus in a retracted view which various embodiments of present disclosure may be implemented.

FIGS. 3A is block diagram of an illustrative embodiment of a side view of an embodiment a removably attachable coupling mechanism 300 to lock filter cartridge 112 in place in non-electric, non-igniting cigarette simulator apparatus 100 (not shown) in which various embodiments of present disclosure may be implemented in an extended view. FIGS. 1 and 3A illustrates one embodiment of removably attachable coupling mechanism 300 to lock filter cartridge 112 in place the distal end 110 on cylindrical body 102 of non-electric, non-igniting cigarette simulator apparatus 100 in the extended view. Filter cartridge 112 may be secured by one or more piston-like handles (not shown). In one embodiment, the one or more piston-like handles 311 may be packaged in a sheath 301. In one embodiment, the one or more piston-like handles 311 open and close through applying mechanical tension. In a preferred embodiment, the one or more piston-like handles 311 are tethered to filter cartridge 112.

Figure 3B:
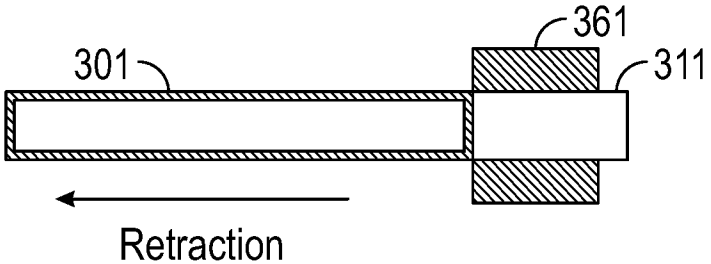
FIG. 3B is a block diagram of an illustrative embodiment of a cross-sectional side view of one embodiment showing a disposable, replaceable filter cartridge and a removably attachable coupling mechanism for a non-electric, non-igniting cigarette simulator apparatus in an retraction view in which various embodiments of present disclosure may be implemented.

FIG. 3B is a block diagram of an illustrative embodiment of a side view of one embodiment showing a removably attachable coupling mechanism 300 for a disposable, replaceable filter cartridge 112 for a non-electric, non-igniting cigarette simulator apparatus in a retracted view in which various embodiments of present disclosure may be implemented. Further, in one embodiment of the present disclosure, filter cartridge 112 comprises one or more piston-like handles 311 and is placed onto the distal end 310 of simulator device to couple to an outer lip 361 on cylindrical body 102 of the simulator apparatus (not shown).

Figure 3C:
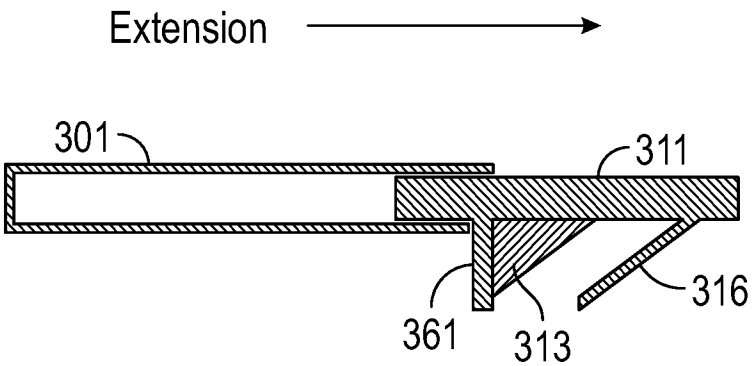
FIG. 3C is a block diagram of an illustrative embodiment of a cross sectional perspective view of one embodiment showing a removably attachable coupling mechanism for a disposable, replaceable filter cartridge for a non-electric, non-igniting cigarette simulator apparatus in an extended view in which various embodiments of present disclosure may be implemented.

FIG. 3C is a block diagram of an illustrative embodiment of a cross-sectional perspective view of one embodiment of removably attachable coupling mechanism for a non-electric non-igniting cigarette simulator apparatus in an extended view in which various embodiments of present disclosure may be implemented. In the present embodiment, removably attachable coupling mechanism 300 locks filter cartridge 112 in place at an extended outer lip 361 located at the distal end 110 on cylindrical body 102 of non-electric, non-igniting cigarette simulator apparatus 100 (not shown) in which various embodiments of present disclosure may be implemented in an extended view.

FIGS. 1 and 3C illustrates an embodiment of removably attachable coupling mechanism 300 to lock filter cartridge 312 in place at outer lip 361 located at the distal end 110 on cylindrical body 102 of non-electric, non-igniting cigarette simulator apparatus 100 in the extended view. In one embodiment, disposable, replaceable filter cartridge 112 may be inserted into the distal end 110 of recessed cavity 107 of main tubing 106 simulator apparatus 102. In one embodiment of the present disclosure, filter cartridge 312 is placed at the distal end 110 of interior chamber 105 of the simulator apparatus 100 to secure filter cartridge 312 firmly in place. In one embodiment of the present disclosure, filter cartridge 312 comprising one or more piston handles 311 is placed onto the distal end 310 and couples to a clip 313 on an outer lip 361 on cylindrical body 302 of the simulator apparatus 102. In one embodiment, removably attachable coupling mechanism comprises one or more hooks 316. In another embodiment of the present disclosure, one end of one or more hooks 316 are connected to one or more piston handles 311, while the other end of one or more piston handles 311 is tethered to filter cartridge 112. In one embodiment, the one or more hooks 316, as illustrated in 3B in their extended view, are extended to connect to filter cartridge 112 via one or more piston handles 311 and secure to clip 313 on an outer lip 361 of simulator apparatus 100. In one embodiment, outer lip 361 is an extended outer lip 361 allowing for a tighter securing of filter cartridge 112.

In one embodiment, the one or more hooks 316 are connected to filter cartridge 112 via one or more piston handles 311 which are located symmetrically around the radius of the filter cartridge 112 and are removably attachable to one or more clip 314 positions located symmetrically around the radius of outer lip 361 of cylindrical body 102 of simulator apparatus 100 and open and close through applying pressure and/or mechanical tension. In a preferred embodiment, the one or more hooks 316 via one or more piston handles 311 are located at the 12:00, 3:00, 6:00 and 9:00 positions on the filter cartridge 112 and are removably attachable to one or more clips 314 located at the 12:00, 3:00, 6:00 and 9:00 positions on outer lip 361 on cylindrical body 302 of simulator apparatus 100.

Figure 3D:
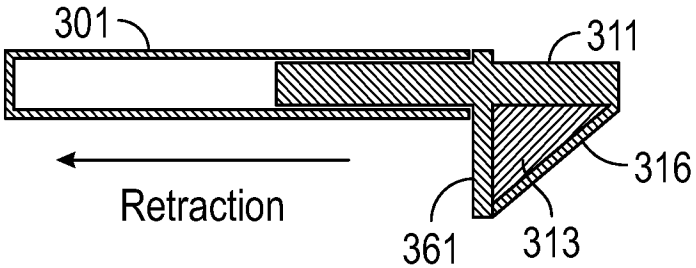
FIG. 3D is a block diagram of an illustrative embodiment of a cross-sectional perspective of one embodiment showing a disposable, replaceable filter cartridge and a removably attachable coupling mechanism for a non-electric, non-igniting cigarette simulator apparatus in an retraction view in which various embodiments of present disclosure may be implemented.

FIG. 3D is a block diagram of an illustrative embodiment of a cross sectional perspective view of one embodiment showing a disposable, replaceable filter cartridge 112 and a removably attachable coupling mechanism 300 for the filter cartridge 112 for a non-electric, non-igniting cigarette simulator apparatus in a retraction view in which various embodiments of present disclosure may be implemented. FIGS. 1 and 3D illustrates an embodiment of removably attachable coupling mechanism 300 to lock filter cartridge 112 in place the distal end 110 on cylindrical body 102 of non-electric non-igniting cigarette simulator apparatus 100 in the retraction view. In one embodiment, removably attachable coupling mechanism comprises filter cartridge 112 which may be secured by one or more piston-like handles 311. In one embodiment, mechanical pressure is or has been applied to piston-like handles 311 tethered to filter cartridge 112 such that cover 362 is in retraction mode. In one embodiment, the piston-like handles 311 open and close through applying mechanical tension. In one embodiment, filter cartridge 112 is substantially locked into place the distal end 110 on cylindrical body 102 of non-electric, non-igniting cigarette simulator apparatus 100, thus enclosing disposable, replaceable filter 112 in recessed cavity 107 of interior main tubing 106 of simulator apparatus 100.

Referring to FIGS. 1 and 3D, in one embodiment of the present disclosure, piston-like handles 311 are tethered to the filter cartridge 112 which are removably attached and coupled to clips 314 on outer lip 361 at the distal end 108 of cylindrical body 102 of simulator apparatus 100. In one embodiment removably attachable coupling mechanism comprises one or more piston-like handles 311. In another embodiment of the present disclosure one end of one or more hooks 316 are connectable to the remote end of one or more piston handles 311, while the other end of one or more piston handles 311 are coupled to filter cartridge 112. In one embodiment, as illustrated in 3D in the retraction view, filter cartridge 112, via one or more piston handles 311 connected to one or more hooks 316, is secured to a clip 314 on an outer lip 361 of simulator apparatus 100. In one embodiment, outer lip 361 is an extended outer lip 361 allowing for a tighter securing of filter cartridge 112.

In one embodiment, the one or more hooks 316 are connected to filter cartridge symmetrically around the radius 112 via one or more piston handles 311 and are removably attached to one or more clips 314 located at positions located symmetrically around the radius at one or more corresponding positions on outer lip 361 of cylindrical body 302 of simulator apparatus 100 and open and close through applying pressure and/or mechanical tension. In a preferred embodiment, one or more piston handles 311 and one or more hooks 316 are located at the 12:00, 3:00, 6:00 and 9:00 and are removably attached to one or more corresponding clips 314 located at the 12:00, 3:00, 6:00 and 9:00 positions on outer lip 361 on cylindrical body 302 of simulator apparatus 100.

Figure 4A:
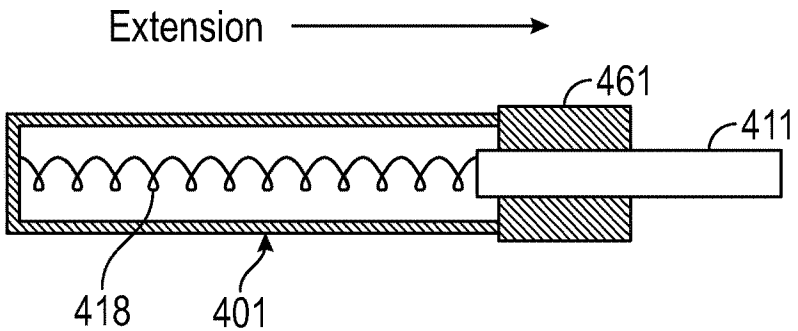
FIG. 4A is a block diagram of an illustrative embodiment of a cross-sectional side view of one embodiment showing a disposable, replaceable filter cartridge and a removably attachable coupling mechanism for a non-electric, non-igniting cigarette simulator apparatus in an extended view in which various embodiments of present disclosure may be implemented.

FIG. 4A is a block diagram of an illustrative embodiment of a cross-sectional side view of one embodiment showing a removably attachable coupling mechanism 400 coupled to filter cartridge 112 of the non-electric, non-igniting cigarette simulator apparatus in an extended view in which various embodiments of present disclosure may be implemented. In this embodiment of the present disclosure, removably attachable coupling mechanism 400 comprises one or more springs 418 which may be tethered 401 to one or more piston-like handles 411 tethered to filter cartridge 112. In one embodiment, removably attachable coupling mechanism 400 further comprises one or more springs 418 in a small sheath 401. In one embodiment of the present disclosure, filter cartridge 112 is placed at the distal end 110 of interior chamber 105 of the simulator apparatus 100 to secure filter cartridge 112 firmly in place.

Figure 4B:
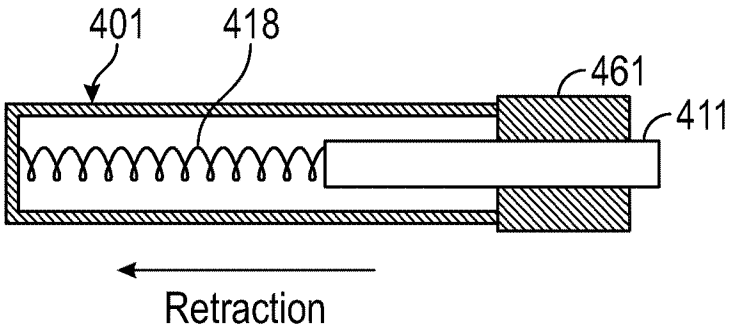
FIG. 4B is a block diagram of another illustrative embodiment of a cross-sectional side view of one embodiment further illustrating a disposable, replaceable filter cartridge and a removably attachable coupling mechanism for a non-electric, no igniting cigarette simulator apparatus in a retracted view which various embodiments of present disclosure may be implemented.

FIG. 4B illustrates embodiment of removably attachable coupling mechanism 400 comprising one or more springs 418 attached to one or more piston handles 411 tethered to filter cartridge 112 in place at an outer lip 461 in the retracted view. In this embodiment of the disclosure, filter cartridge 412 comprises one or more springs 418 which may be tethered in sheath 401 to one or more piston-like handles 411 that are removably attached to outer lip 461 of cylindrical body 102 of simulator apparatus 100. In one embodiment of the present disclosure, filter cartridge 112 is connected to one or more piston handles 411 and one or more hooks 416 In one embodiment of the present disclosure, piston handles 411 are tethered to the filter cartridge 112. In one embodiment, the one or more springs 418 may be tethered in sheath 401 to filter cartridge 112, and opens and closes through applying mechanical tension and/or by applying pressure to the one or more springs 418 tethered to one or more piston handles 411 and tethered to filter cartridge 112.

FIG. 4C is a block diagram of an illustrative embodiment of a cross sectional perspective view of one embodiment showing a disposable, replaceable filter cartridge 412 and a removably attachable coupling mechanism for a non-electric, non-igniting cigarette simulator apparatus in an extended view in which various embodiments of present disclosure may be implemented. Referring to FIGS. 1 and 4B, in one embodiment, filter cartridge 112 includes springs 418 which may be tethered in sheath 461 to one or more piston handles 411 tethered to filter cartridge 112. Filter cartridge 112 is removably attachable to simulator apparatus 100. In one embodiment of the present disclosure, filter cartridge 112 is connected one or more piston handles 411 and one or more small hooks 416. In one embodiment of the present disclosure, piston handles 411 are tethered to the filter cartridge 112 which is removably attachable to the outer lip 461 at the distal end 108 of cylindrical body 102 of simulator apparatus 100. In one embodiment, removably attachable coupling mechanism 400 comprises one or more piston handles 411 connected to one or more hooks 416 and filter cartridge 112. In another embodiment of the present disclosure, the adjacent end of one or more hooks 416 are connectable to the remote end of one or more piston handles 411, while adjacent end of one or more piston-like handles 411 are tethered to the filter cartridge 112. In another embodiment of the present disclosure, the one or more springs 418 are tethered to the one or more piston-like handles 411 and to the filter cartridge 112. Next, the one or more piston-like handles 411 are attached to the one or more hooks 416 connected to an outer lip 461 of cylindrical body 102 of the simulator apparatus 100. In another embodiment, the one or more piston-like handles 411 are attached to the one or more hooks 416 connected to one or more clips 413 on an outer lip 461 of cylindrical body 102 of the simulator apparatus 100. In one embodiment outer lip 461 is an extended outer lip 461 allowing for a tighter securing of filter cartridge 412.

In one embodiment of the present disclosure, clip mechanism 400, which secures filter cartridge 412 in place at an outer lip 461 located at the distal end 108 cylindrical body 102 of non-electric, non-igniting cigarette simulator apparatus 100 in the extension view is illustrated. In this embodiment of the disclosure, removably attachable coupling mechanism 400 comprises filter cartridge 112 further comprising one or more springs 418 which may be tethered in sheath 401 to one or a ore piston handles 411 that are removably attachable to outer lip 461 of cylindrical body 102 of simulator apparatus 100. In one embodiment, the one or more springs 418, tethered in sheath 401 are coupled to one or ore hooks 416 via one or more to more piston handles 411 tethered to filter cartridge 412 and removably attachable to one or more clips 413 on outer lip 461 of cylindrical body 102 of simulator apparatus 100 and open and close through applying mechanical tension.

FIG. 4C illustrates one embodiment of one or more springs 418 and one or more piston handles 411 tethered to filter cartridge 412 prior to applying pressure or mechanical tension to the one more piston like handles 411 on filter cartridge 412. In a preferred embodiment, the one or more hooks 416 tethered to the one or more piston handles 411 tethered to filter cartridge 412 are located at the 12:00, 3:00, 6:00 and 9:00 positions and are removably attachable at coordinating positions to one or more clips 413 on outer lip 461 of cylindrical body 102 of simulator apparatus 100. In the extension view, as illustrated in FIG. 4C, mechanical tension has not yet been applied to filter cartridge 112 or the one or more piston-like 411 handles on filter cartridge 412 to lock into the one or more hooks 416 to clips 413 on outer lip 461 of cylindrical body 102 of simulator apparatus 100. In one embodiment, the one or more hooks 416 are connected to filter cartridge 112 symmetrically around the radius via one or more piston handles 411 and are removably attached to one or more clips 414 located at positions located symmetrically around the radius at one or more corresponding positions on outer lip 461 of cylindrical body 102 of simulator apparatus 100 and open and close through applying pressure and/or mechanical tension.

FIG. 4D is a block diagram of another illustrative embodiment of a cross-sectional perspective view of one embodiment further illustrating a disposable, replaceable filter cartridge and a removably attachable coupling mechanism for a non-electric, non-igniting cigarette simulator apparatus in a retracted view which various embodiments of present disclosure may be implemented. Referring to FIG. 1 and FIG. 4D an embodiment of removably attachable coupling mechanism 400 locking filter cartridge 112 in place at an outer lip 461 located at the distal end 108 cylindrical body 102 of non-electric, non-igniting cigarette simulator apparatus 100 in the retracted view is illustrated. In this embodiment of the disclosure, filter cartridge 112 comprises one or ore springs 418 which may be tethered in a sheath 401 and tethered to filter cartridge 112 and to one or more piston-like handles 411 that are removably attached to simulator apparatus 100. In one embodiment, the one or more springs 418 may be tethered in sheath 401 to filter cartridge 112 that is removably attached to outer lip 461 of cylindrical body 102 of simulator apparatus 100. In an embodiment of the disclosure, filter cartridge 112 may be inserted and removed through applying mechanical tension and/or by applying pressure to the one or more springs 418 tethered in sheath 401 through one or more piston-like handles 411 tethered to filter cartridge 112.

In one embodiment of the present disclosure, the removably attachable coupling mechanism 400 comprises one or more springs 418 which may be tethered in sheath 401 to one or more piston-like handles 411 having hooks 416 that are removably attachable to clips 413 on outer lip 461 of simulator apparatus 100 illustrated in FIGS. 1, 4A, 48, 4C, and 40, function secure disposable, replaceable filter cartridge 412 in place in simulator apparatus 100. In another embodiment of the present disclosure, the one or more springs 418 are tethered to the one or more piston-like handles 411 and to filter cartridge 112. Next, one or more hooks 416 are removably attachable to the one or more piston-like handles 411 and the one or lore hooks 416 are connected to clips 413 on outer lip 461 of cylindrical body 102 of the simulator apparatus 100. In In another embodiment of the present disclosure, removably attachable coupling mechanism comprises one or more hooks 416. In another embodiment of the present disclosure, one end of one or more hooks 416 are connectable to the remote end of one or more piston-like handles 411 and one or more springs 418, while one end of the one or more springs 418 and one or more piston-like handles 411 are tethered to the filter cartridge 112. In one embodiment, as illustrated in 40 in the retraction view, filter cartridge 112, via and one or more springs 418 one or more piston-like handles 411 are connected to one or more hooks 416, and are secured to clips 413 of outer lip 461 of simulator apparatus 100. In one embodiment, outer lip 461 is an extended outer lip 461 allowing for a tighter securing of filter cartridge 112.

In a preferred embodiment, the one or more hooks 416 on the distal end of the one or more piston-like handles 411 are located at the 12:00, 3:00, 6:00 and 9:00 positions on filter cartridge 412 and are removably attached to one or more clips 413 located at the corresponding 12:00, 3:00, 6:00 and 9:00 positions on outer lip 461 of cylindrical body 102 of simulator apparatus 100.

In the retraction view, as illustrated in FIG. 40, mechanical tension has or is being applied to cover 462 so that the one or more hooks 416 on the distal end of the one or more piston-like handles 411 lock to clips 413 on outer lip 461 of cylindrical body 102 of simulator apparatus 100. In another embodiment, there are be one, or more hooks 416 located at one or more various positions of filter cartridge 112 and are removably attached to one or more clips 413 located at one or more various corresponding positions on outer lip 461 of cylindrical body 102 of simulator apparatus 100. The one or more springs 418 tethered in sheath 401 are compressed in the retraction state by pressure and/or mechanical tension when filter cartridge 112 is connected to cylindrical body 102 of the non-electric, non-igniting cigarette simulator apparatus 100.

Figure 5A:
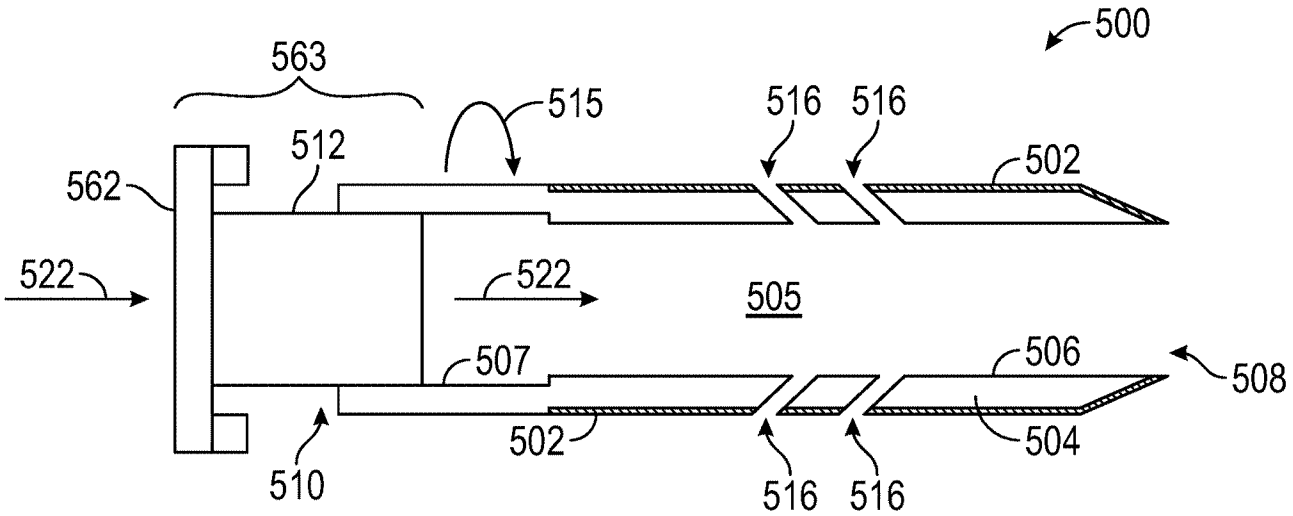
FIG. 5A is a block diagram of an illustrative embodiment of a cross-sectional side view of one embodiment showing a disposable, replaceable filter cartridge and a removably attachable coupling mechanism a non-electric, non-igniting cigarette simulator apparatus in an extended view in which various embodiments of present disclosure may be implemented.
Figure 5B:
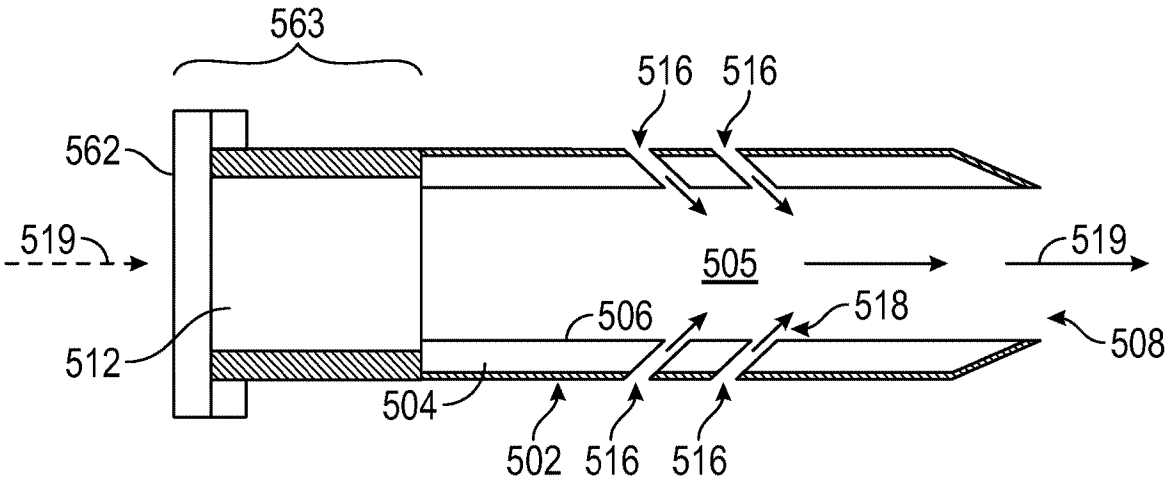
FIG. 5B is a block diagram of another illustrative embodiment of a cross-sectional side view of one embodiment further illustrating a disposable, replaceable filter cartridge and a removably attachable coupling mechanism for a non-electric, non-igniting cigarette simulator apparatus in a retracted view which various embodiments of present disclosure may be implemented.

FIG. 5A is a block diagram of an illustrative embodiment of a cross-sectional side view of one embodiment showing a disposable, replaceable filter cartridge and a clip mechanism for a non-electric, non-igniting cigarette simulator apparatus 500 in an extended view in which various embodiments of present disclosure may be implemented. In one embodiment of the present disclosure, disposable, replaceable filter cartridge 12 and cover 562 are coupled together as a single insertable filter cartridge, removably attachable coupling and cover 563 for ease of use. In the present embodiment, filter cartridge 563 illustrated in FIG. 5A in the extended view shows filter cartridge 563 being inserted into the distal end 510 of the non-electric, non-igniting cigarette simulator apparatus 500 strafed by arrows 522. In an embodiment of the present disclosure, the distal end 510 of the interior chamber 505 of the main tubing 506 cylindrical body 502 comprises recessed cavity 507 for containing filter cartridge, clip and cover 563. In one embodiment, filter cartridge, clip and cover 563 is screwed on as illustrated by arrow 515. In one embodiment, there is threading (not shown) on cylindrical body 502 of simulator apparatus 500 and corresponding threading on filter cartridge 563 (not shown). In one embodiment of the present disclosure, filter cartridge 563 may be secured by threading/screwing onto the distal end 510 of simulator apparatus 500. Another embodiment may comprise filter cartridge 563 attached to an outer lip 114 at the distal end 510 of a non-electric, non-igniting cigarette simulator apparatus 500 as illustrated in FIG. 1. Filter cartridge 563 may further comprise hooks, springs, clips or other mechanisms, now known or later developed, which may be used to removably attach filter cartridge, clip and cover 563 to non-electric, non-igniting cigarette simulator apparatus 500.

FIG. 56 is a block diagram of another illustrative embodiment of a cross-sectional side view of one embodiment further illustrating a disposable, replaceable filter cartridge and a clip mechanism for a non-electric, non-igniting cigarette simulator apparatus 500 in a retracted view which various embodiments of present disclosure may be implemented. In one embodiment of the present disclosure, disposable, replaceable filter cartridge 512, removably attachable coupling and cover 562 are coupled together as a single insertable filter cartridge 563 for ease of use. In the present embodiment, filter cartridge 563 illustrated in FIG. 5B in the retracted view shows filter cartridge 563 is inserted into the distal end 510 of the non-electric non-igniting, cigarette simulator apparatus 500 as illustrated by arrows 522. In an embodiment of the present disclosure, the distal end 510 of the interior chamber 505 of the main tubing 506 cylindrical body 502 comprises recessed cavity 507 for containing filter cartridge 563.

As illustrated in FIG. 56, in one embodiment once filter cartridge 563 inserted into recessed cavity 507 of main tubing 506 of interior chamber 505 of non-electric, non-igniting cigarette simulator apparatus 501, air flows 519 through the distal end 510 of interior chamber 505 of non-electric, non-igniting cigarette simulator apparatus 501 through filter cartridge 563 and additional air flows 518 in via side vents 516 and finally out through the proximal end 508.

In one embodiment of the disclosure a method is disclosed. The method comprises providing cigarette simulator apparatus 500. The simulator apparatus further comprises a cylindrical body 502 tapered slightly at the proximal inhalation end 508, wherein the interior of the cylindrical body 502 has an interior cylindrical chamber 505 and a main tubing 506 configured to traverse the entire length of the cylindrical body 502. Next, a disposable, replaceable filter cartridge, removably attachable coupling and cover 563 is inserted into the distal end 510 of a recessed cavity 507 of the main tubing 506 of the interior cylindrical chamber 505, wherein the filter cartridge, removably attachable coupling and cover 563 comprises a contents including a base, spinach, ginger, cranberry extracts, carrot, pomegranate, citrus extract, broccoli, wheat germ and kale. Then, filter cartridge, clip and cover 563 is threaded or screwed on the distal end 510 of cylindrical body 502 of simulator device. Finally, air is diffused 519 though the distal end 510 of the simulator apparatus 510 through the contents of the filter cartridge, ell p and cover 563 allowing for air dispersal 519 into the main tubing 506 of the interior cylindrical chamber 505 to the proximal end 508 of the simulator apparatus 500 when in use by a user of the simulator apparatus 500.

Figure 6:
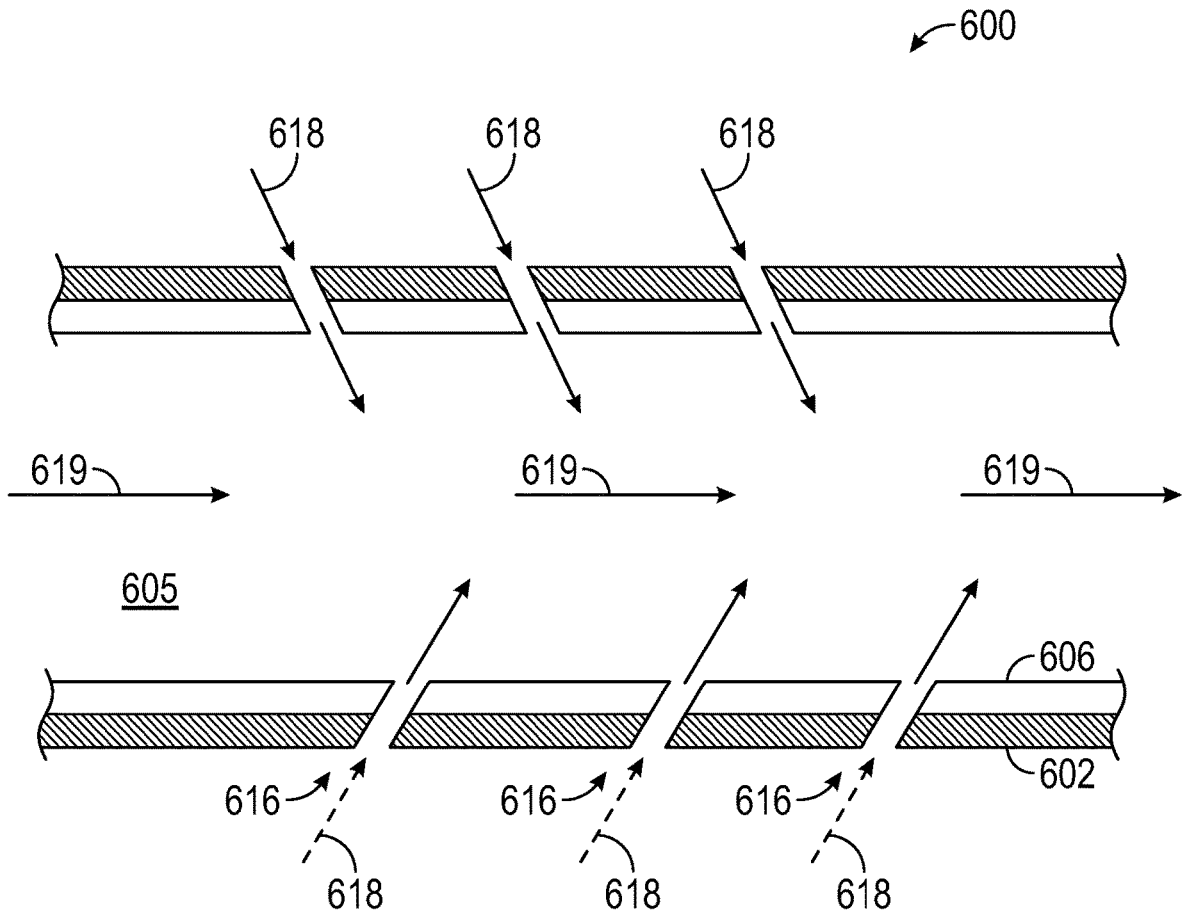
FIG. 6 is a block diagram of an illustrative embodiment of a cross-sectional side view of a non-electric, non-igniting cigarette simulator apparatus detailing the additional side vents in which various embodiments of present disclosure may be implemented.

FIG. 6 is a block diagram of an illustrative embodiment of a cross-sectional side view 600 of a non-electric, non-igniting cigarette simulator apparatus 100 detailing side vents 616 in which various embodiments of present disclosure may be implemented. Referring to FIGS. 1 and 6, when non-electric, non-igniting cigarette simulator apparatus 100 is use by a user, air flows through disposable, replaceable filter cartridge 112, activating component constituents of filter cartridge 112 shown by air flow arrows 619. In use, a user inhales the component constituents of the filter cartridge 112 via the proximal inhalation end 108 of the simulator apparatus 100 allowing for air dispersal into the interior cylindrical area 604 of the cylindrical body 602 via the distal end 119 and one or more air vents 118 when in use by a user of non-electric, non-igniting cigarette simulator apparatus 100.

Non-electric, non-igniting cigarette simulator apparatus 100 is configured such that air flows through disposable replaceable filter cartridge 12, activating component constituents of filter cartridge 112 shown by air flow arrows 619 at distal end 110 via simulator apparatus' 100 cylindrical casing, main tubing 106 to cylindrical body 602 through to interior chamber 605. Side vents 616 allow additional air to diffuse through to proximal inhalation end to further diffuse component constituents of filter cartridge 112.

Side vents 616 may be 0.5-1.0 mm in diameter allowing additional air 518 (illustrated by perforated lines) to diffuse into simulator apparatus 100. Side vents 616 may be at an angle of 90° and 170° between the main tubing 606 of interior chamber 605 and the cylindrical body 602. Side vents 616 are designed to increase the air flow 618 to interior chamber 606 of the simulator apparatus 100 as illustrated by arrows 618. In another embodiment of the present disclosure, side vents 616 are at an angle of 45° and 100° between the interior main tubing 606 of interior chamber 605 and the cylindrical body 602. In preferred embodiment, side vents 616 are at an angle of 75° and 90° between the main tubing 606 of interior chamber 605 and the cylindrical body 602.

In a preferred embodiment of the present disclosure, side vents 616 allow additional air flow 618 such that the vapors from the component constituents of disposable, replaceable filter cartridge 612 to pass through the main tubing 606 of interior chamber 605 of the simulator apparatus 100 may be more gradually inhaled into a user's lungs, reducing the likelihood of any systemic irritation to the lungs of a user from the vapor concentration in the disposable, replaceable filter cartridge 112. In a preferred embodiment, side vents 616 prolong the use-life of the component constituents in disposable, replaceable filter cartridge 112, hence a user does not have to replace it more frequently.

Referring back to FIGS. 1 and 6, in an embodiment of the present disclosure, the perforated arrows 618 indicate the airflow directions through the side vents 616 through the interior main tubing 606 of interior chamber 605 of the simulator apparatus 100, while the solid arrows indicate the airflow directions from the distal end 619 of disposable, replaceable filter cartridge 112 to pass through the main tubing 606 of interior chamber 605 of the simulator apparatus 100 as air flows through while in use.

Figure 7B:
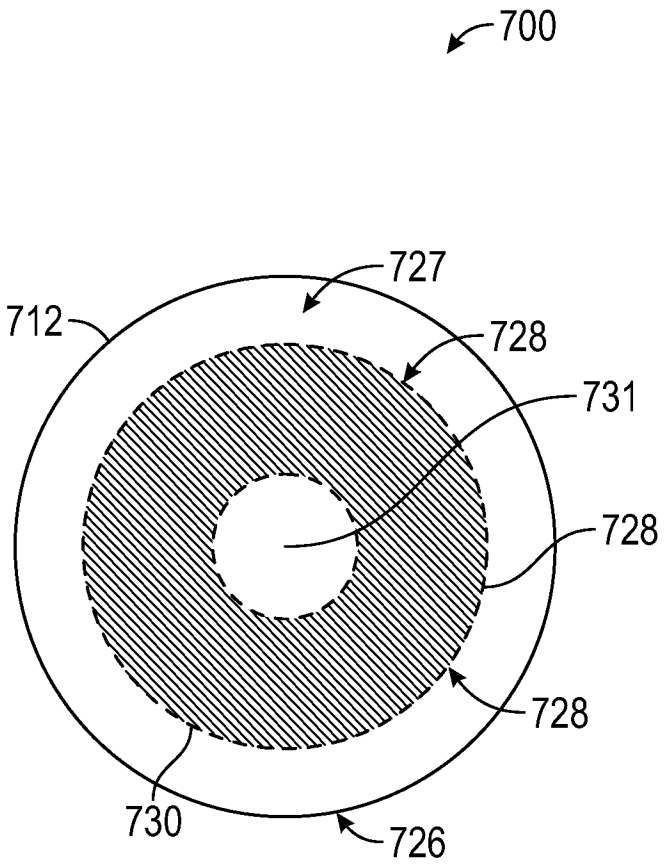
FIG. 7B is a block diagram of an illustrative embodiment of cross-sectional view from a top down perspective of the filter cartridge of a non-electric, non-igniting cigarette simulator apparatus which various embodiments of present disclosure may be implemented.
Figure 7A:
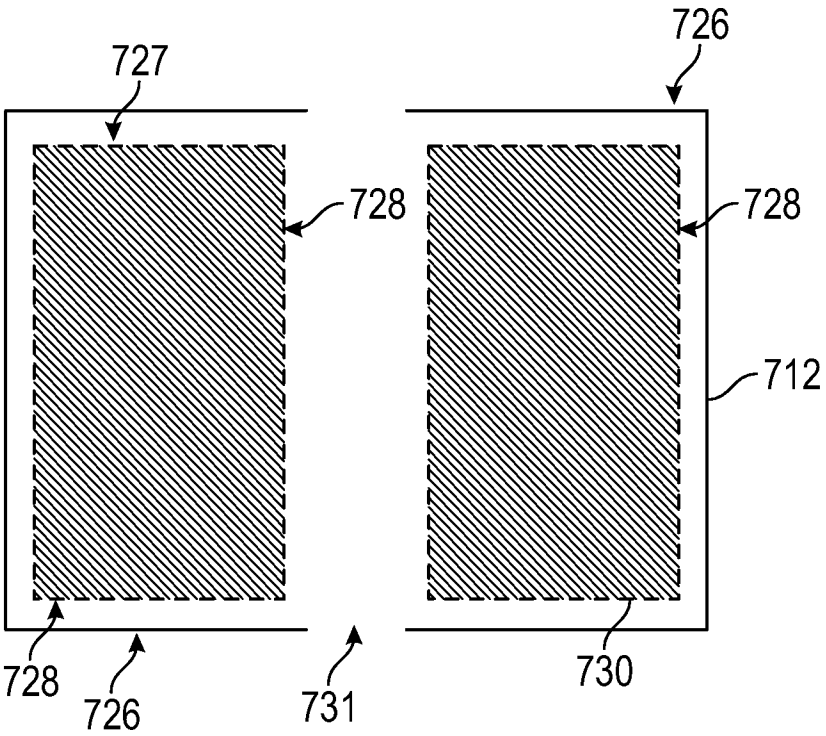
FIG. 7A is a block diagram of an illustrative embodiment of sectional view from a side perspective of the filter cartridge of a non-electric, non-igniting cigarette simulator apparatus which various embodiments of present disclosure may be implemented.

FIG. 7A and FIG. 7B are block diagrams of an illustrative embodiment 700 of cross-sectional view from a both side 700*a* and top-down 700*b* perspective of the disposable replaceable filter cartridge 712 of a non-electric, non-igniting cigarette simulator apparatus 100 (not shown) which various embodiments of present disclosure may be implemented. Referring to FIGS. 1, 7A and 7B, in a preferred embodiment of the present disclosure, the filter cartridge 712 is cylindrical in shape, as illustrative embodiment of cross-sectional view from the top-down perspective of the filter cartridge 712. In one embodiment, filter cartridge 712 has a plastic shell 726 which aligns with recessed cavity 107 of the main tubing 106 of interior chamber 105 of the simulator apparatus 100. In one embodiment, plastic shell 726 may be comprised of poly-dimethyl sulfate (PDMS). In one embodiment, disposable, replaceable filter cartridge 712 comprises a center cavity 731 which aligns with interior chamber 105 of the simulator apparatus 100 and exterior cavity 727 which aligns with plastic shell 726. The interior material 730 of filter cartridge 712 is fenestrated 728 along interior center cavity 731 and exterior cavity 727. The interior enter cavity 731 and exterior cavity 727 of filter cartridge 712 are fenestrated 728 to allow for diffusion of component constituents. In one embodiment of the present disclosure, the filter cartridge 712 underlying material 730 may be composed of a diffusible gelatin based polymer containing highly concentrated component constituents of extracts proven to flush nicotine out of the body and reduce the craving for cigarette smoking. As a user inhales on proximal end 108 of simulator 100, the airflow 119 will slowly collect the diffusible component constituents via distal end 110 and air flow 118 is introduced via side vents 116, which the user will inhale in place of the harmful compounds found in cigarettes, gradually weaning them off their addiction to tobacco.

In one embodiment, the interior material 730 of filter cartridge 712 may be comprised of a vegetable-based gelatin 730. In another embodiment, the interior material 730 of disposable, replaceable filter cartridge 712 is comprised of a vegetable-based gelatin, laminated film with a multilayer barrier. In another embodiment, the vegetable-based gelatin laminated film with a multilayer barrier 730 comprises a base compound that is mentholated. In another embodiment of the present disclosure the interior material 730 of disposable, replaceable filter cartridge 712 may be fenestrated 728 to allow the mentholated constituent components containing smoking-reducing ingredients to diffuse thoroughly through simulator device 100 to a user.

Figure 8:
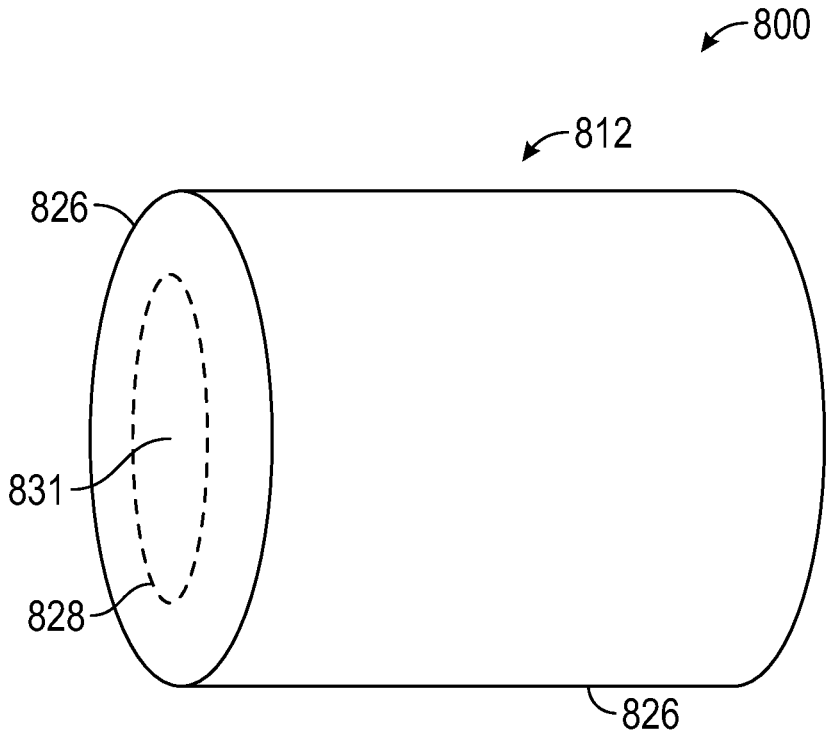
FIG. 8 is a block diagram of an illustrative embodiment of the filter cartridge of a non-electric, non-igniting cigarette simulator apparatus which various embodiments of present disclosure may be implemented.

In one embodiment of the present disclosure, once filter cartridge 712 is opened from an individual package, diffusion of interior material 730 of disposable, replaceable filter cartridge 712 constituent components will activate due to reaction with air. The diffusion of constituent components may be accelerated by air flow 119 through the simulator apparatus 100. Diffusion continues until interior material 730 of disposable, replaceable filter cartridge 712 constituent components dries into a solid core FIG. 8 is a block diagram of an illustrative embodiment 800 of the filter cartridge 812 of a non-electric, non-igniting cigarette simulator apparatus 100 (not shown) which various embodiments of present disclosure may be implemented. Referring to FIGS. 1 and 8, in a preferred embodiment of the present disclosure, the filter cartridge 812 is cylindrical in shape, in one embodiment, filter cartridge 812 has a plastic shell 826 which aligns with recessed cavity 107 of the main tubing 106 of interior chamber 105 of the simulator apparatus 100. Disposable, replaceable filter cartridge 812 comprises a center cavity 811 which aligns with of the main tubing 106 of interior chamber 105 of the simulator apparatus 100. The interior material 830 of filter cartridge 812 is fenestrated 828 along the internal cavity which aligns with recessed cavity 107 and along the interior all of filter cartridge 812 to allow for diffusion of constituent components (not shown).

Referring to FIGS. 1 and 8, in one embodiment, the filter cartridge 812 may have a diameter that is 2.0-1.0 mm less than the diameter of the recessed cavity 107 of the main tubing 106. In the one embodiment, the disposable, replaceable filter cartridge 812 may have a diameter that is 0.075-0.5 mm less than the diameter of the recessed cavity 107 of the main tubing 106 at the distal end 810 of the interior chamber 105 of cylindrical body 102 of the non-electric, non-igniting cigarette simulator apparatus 100. In yet another embodiment, the disposable replaceable filter cartridge 812 may have a diameter that is 0.075-0.5 mm less than the diameter of the recessed cavity 197 of the main tubing 106 at the distal end 110 of the interior chamber 105 of cylindrical body 102 of the non-electric, non-igniting cigarette simulator apparatus 100. In one embodiment, the disposable, replaceable filter cartridge 812 may have a length and diameter that is than or equal to the length and diameter of the recessed cavity 107 of the main tubing 106 at the distal end 110 of the interior chamber 105 of cylindrical body 102 of the non-electric, non-igniting cigarette simulator apparatus 100.

Figure 9:
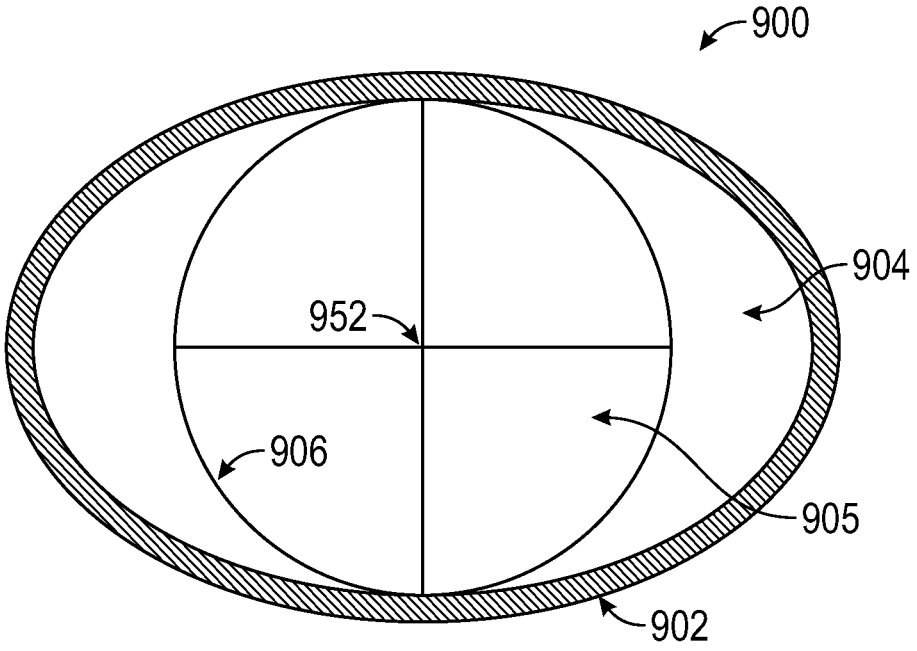
FIG. 9 is a block diagram of an illustrative embodiment of a proximal front view of a non-electric, non-igniting cigarette simulator apparatus in which various embodiments of the present disclosure may be implemented.

FIG. 9 is a block diagram of an illustrative embodiment of proximal front view 900 of a non-electric, non-igniting cigarette simulator apparatus 100 in which various embodiments of the present disclosure may be implemented. In one embodiment, the proximal front view 900 is comprised of cylindrical body 902, cylindrical casing 904 and interior chamber 905 comprised of interior main tubing 906 which transverses the entire length of the simulator apparatus 100. In another embodiment, a support structure 952 may be used to prolong the use-life of a non-electric, non-igniting cigarette simulator apparatus 100.

Referring to FIGS. 1 and 9, in one embodiment of the present disclosure, the proximal front end 900 of the cylindrical non-electric, non-igniting cigarette simulator apparatus 100 is slightly tapered at the proximal front end 900 of cylindrical body 102 through cylindrical casing 104 to interior chamber 905 of the main tubing 1006 of the simulator apparatus 100 as illustrated in FIG. 1. In an embodiment of the present disclosure the proximal front end 900 is tapered between 5° and 50°. In another embodiment, the proximal end 900 is tapered between 20° and 25°.

Figure 10:
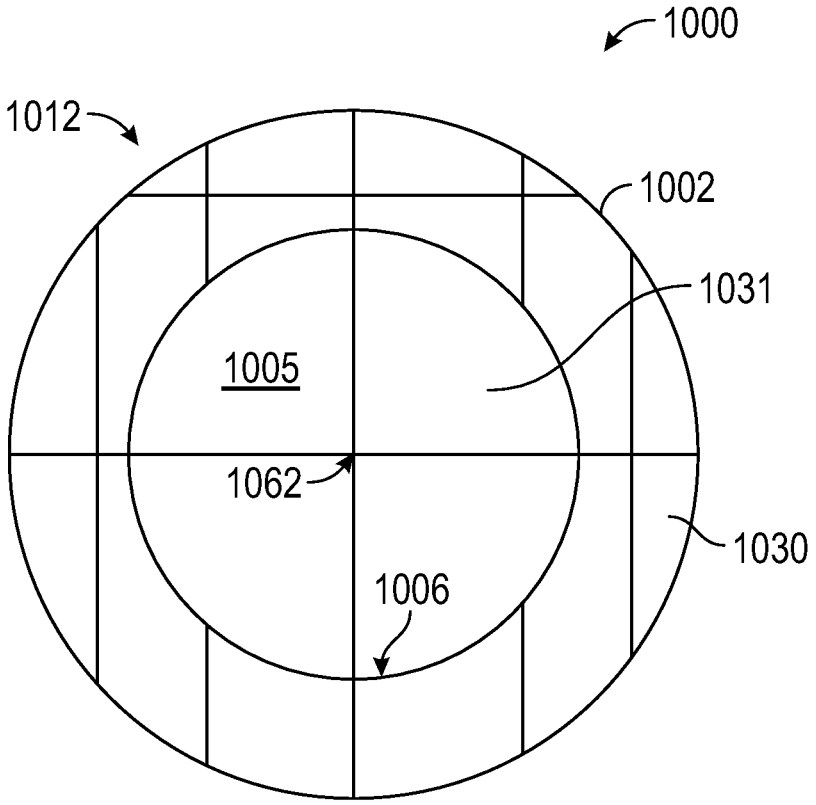
FIG. 10 is a block diagram of an illustrative embodiment the distal end of a non-electric, non-igniting cigarette simulator apparatus in which various embodiments of the present disclosure may be implemented.

FIG. 10 is a block diagram of an illustrative embodiment of distal end 1000 view of a non-electric, non-igniting cigarette simulator apparatus 1000 in which various embodiments of the present disclosure may be implemented. Referring to FIGS. 1 and 10, the distal end 1000 of non-electric, non-igniting cigarette simulator apparatus 100 has cylindrical body 1102 through cylindrical casing 104 to interior chamber 105 of main tubing 106 of simulator apparatus 100. G. 10 illustrates an embodiment of the distal end 1000 view of simulator apparatus 100, center cavity 1031 of disposable, replaceable filter 1012 aligns with recessed cavity 1007 of the of main tubing 106 of interior chamber 105 of non-electric, non-igniting cigarette simulator apparatus 100. In one embodiment of the present disclosure, the majority of the distal end 1060 of non-igniting cigarette simulator apparatus 100 is hollow due to center cavity 1031 of disposable, replaceable filter 1012 which aligns with the recessed cavity 107 of main tubing 106 of interior chamber 105 of simulator apparatus 100.

In one embodiment, cover 1062 removably attaches to outer lip (not shown) secures disposable, replaceable filter cartridge 1012 into recessed cavity 1007 of main tubing 106 of the simulator apparatus 100. In another embodiment, a cover secures replaceable filter cartridge 112 directly onto cylindrical body 102 of non-electric, non-igniting cigarette simulator apparatus 100.

To, cover disposable, replaceable filter cartridge 112 and avoid confusion with a cigarette holder, for example, in one embodiment, cover 1162 shields disposable, replaceable filter cartridge 112 on simulator apparatus 100. In a preferred embodiment, cover 1062 comprises a grid. In another embodiment, a screen, web or netting could be used as cover 1062. Other mechanisms, now known or later developed, may be used as cover 1062 for non-electric, non-igniting cigarette simulator apparatus 100. In one embodiment of the present disclosure, cover 1062 may be between 1.5 and 2.5 mm in length. In another, embodiment of the present disclosure, grid cover 1162 may be between 1.0 and 2.0 mm in length. In yet another, embodiment of the present disclosure, cover 1162 may be between 0.90 and 0.5 mm in length. In one embodiment of the present disclosure, cover 1062 may be between 1.5 and 2.0 cm in diameter. In another, embodiment of the present disclosure, grid cover 1062 may be between 1.3 and 1.0 cm in diameter. In another embodiment of the present disclosure, cover 1062 may be between 1.0 and 0.75 cm in diameter.

Figure 11:
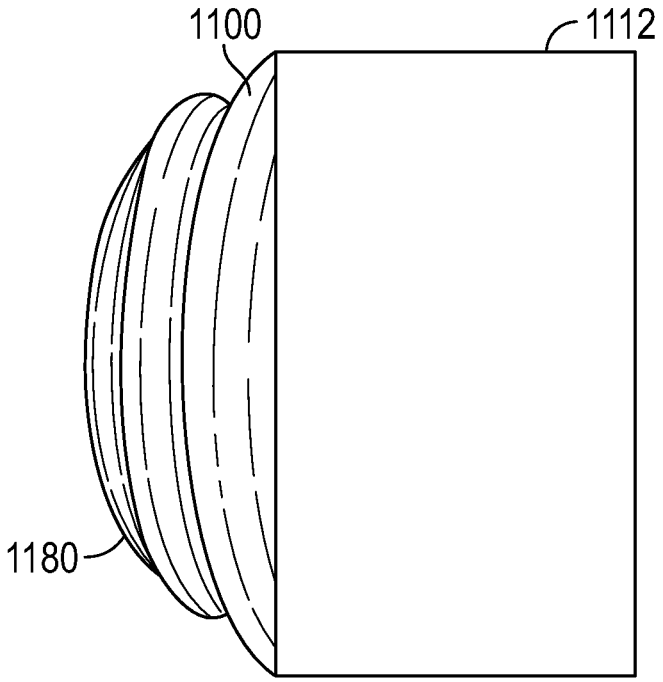
FIG. 11 is a block diagram of an illustrative embodiment of the distal end of a non-electric, non-igniting cigarette simulator apparatus in which various embodiments of the present disclosure may be implemented.

FIG. 11 is a block diagram of an illustrative embodiment 1200 of a side view of the distal end 1110 of a non-electric non-igniting cigarette simulator apparatus 100 in which various embodiments of the present disclosure may be implemented. In one embodiment of the present disclosure, the distal end 1110 of a non-electric, non-igniting cigarette simulator apparatus 100 may comprise a threaded distal end 1180. A cover (not shown) is secured by threading the cover onto the distal end 1110 of simulator apparatus 100. Referring to FIGS. 1, 2, 3 and 4, in another embodiment, the distal end 1110 of a non-electric, non-igniting cigarette simulator apparatus 100 may comprise a cover 162 attached to an outer lip 114. The cover 162 may further comprise hooks, springs, clips or other mechanisms, now known or later developed, may be used to cover to non-electric, non-igniting cigarette simulator apparatus 100.

Figure 12:
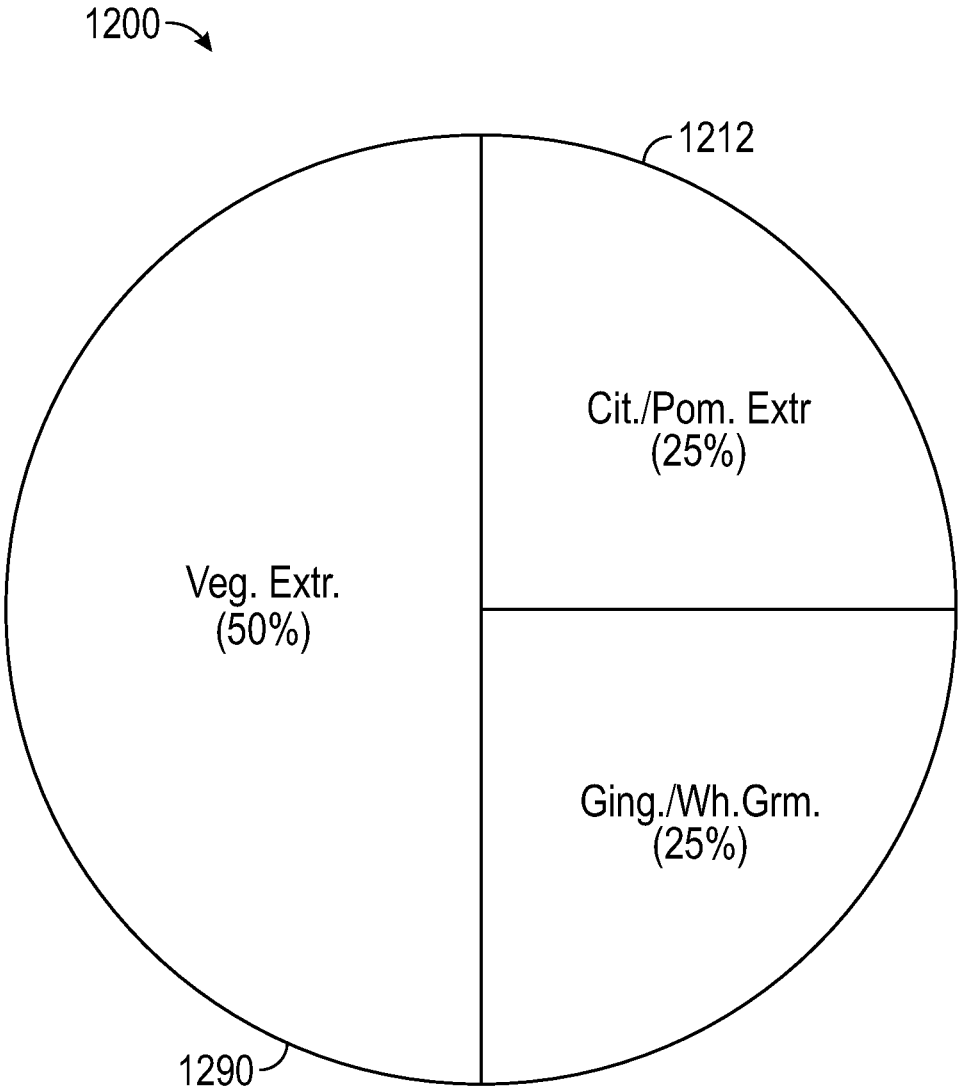
FIG. 12 is a graph diagram of one illustrative embodiment of constituent components of the filter cartridge in the non-electric, non-igniting cigarette simulator apparatus in which various embodiments of present disclosure may be implemented.

FIG. 12 is a graph 1200 of one illustrative embodiment of one embodiment of constituent components 1290 of the disposable, replaceable filter cartridge 1212 in the non-electric, non-igniting cigarette simulator apparatus 100 in which various embodiments of present disclosure may be implemented. In one embodiment of the present disclosure, the disposable replaceable filter cartridge 1212 constituent components 290 comprise a base, spinach, ginger, cranberry extracts, carrot, pomegranate, citrus extract, broccoli, wheat germ and kale. In another embodiment of the present disclosure, the disposable replaceable filter cartridge 1212 constituent components 1200 comprise a base which further comprises a highly concentrated menthol compound. In another embodiment of the present disclosure, the disposable replaceable filter cartridge 1212 constituent components 1200 comprise a base which comprises a highly concentrated menthol compound, extracts from licorice, red clover, fava bean and turmeric.

In one embodiment, the disposable replaceable filter cartridge 1212 constituent components 1200 may comprise 50% vegetable extract, 25% citrus and pomegranate extract and 25% ginger and wheat germ extract. In another embodiment, the constituent components 1300 of the filter cartridge 1212 component constituents 1200 may be 15% spinach 10% ginger, 12% carrot, 8% cranberry extract, 10% pomegranate, 10% citrus extracts, 10% broccoli, 10% wheat germ and 10%. Spinach: contains folic acid which reduces withdrawal symptoms and sleep regulator and vitamin B9 which maintains healthy tissues. As one of ordinary skill in the art would readily recognize, these percentages are merely samples and may be changed, as may the ingredients, depending on efficacy.

Ginger contains terpenes and volatile oils which boosts circulation, lowers blood pressure and is an effective blood thinner. Cranberry Extracts contain vitamin C and antioxidants which are known to prevent cellular damage and heal tissues. Carrot which contains vitamins A, C, and K which are immunity bolsters and metabolism regulators. Pomegranate contains antioxidants which may prevent cellular damage and heal tissues. Citrus extracts containing orange, lemon and lime which contain vitamin C that may regulate metabolism. Broccoli contains vitamins B5 and C which regulate metabolism and (NRF2) prevents oxidative stress attack on lungs. Wheat Germ contains Vitamin E which maintains tissue elasticity, especially in the lungs. Kale contains fiber minerals, and Isothiocyanate, an antioxidant.

In another embodiment, the disposable replaceable filter cartridge 1212 may include other constituent components 1200 such as extracts from licorice (*Glycyrrhiza glabra*), red clover (*Trifolium pretense*), fava bean (*Vicia faba*), and turmeric (*Curcuma long*). All of these aforementioned constituents reduce craving for cigarettes and improve physical health. As one of ordinary skill in the art would readily recognize, as new constituent component 1300 may be discovered and added or known components may be determined to have new useful properties beneficial to the use of non-electric, non-igniting cigarette simulator apparatus 100. Thus, the present constituent components 1100 are meant to be regarded in an illustrative rather than a restrictive sense.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawing are, accordingly, to be regarded in an illustrative rather than a restrictive sense.

We claim:

1. A non-igniting, non-electric cigarette simulator system comprising:

a cylindrical body, wherein the cylindrical body has an interior chamber and a main tubing which traverses the entire length of the cylindrical body;

a proximal end located on the cylindrical body and configured for a user to inhale from;

one or more air vents on one or more adjacent sides of the cylindrical body allowing for air diffusion from ambient air outside of the cylindrical body to the interior chamber, wherein the air vents increase the air flow when the simulator is in use and dilute vapor concentration from the cartridge;

a disposable, replaceable cartridge insertable into a recessed cavity of the main tubing in the interior chamber of a distal end of the cylindrical body, wherein the cartridge is consisting of component constituents and the component constituents do not have any nicotine; and wherein the cartridge is in direct and continuous fluid communication with the one or more air vents when the cartridge is inserted into the recessed cavity of the main tubing;

a cover, wherein the cover is attached to the cartridge and coupled to a removably attachable coupling mechanism securing the cartridge in place in the recessed cavity of the main tubing at the distal end of the cylindrical body; and wherein the one or more air vents are angled toward the proximal end and away from the distal end such that air flow is directed from an exterior of the cylindrical body and toward the proximal end in order to draw air from the cartridge toward the distal end when the distal end is inhaled from.

2. The system of claim 1 wherein the removably attachable coupling mechanism comprises securing the cartridge onto the simulator apparatus with a threaded lock.

3. The system of claim 1 wherein the removably attachable coupling mechanism comprises securing the cartridge onto the simulator apparatus with a clip.

4. A non-igniting, non-electric cigarette simulator system comprising:

a cylindrical body, wherein the cylindrical body has an interior chamber and a main tubing which traverses the entire length of the cylindrical body;

a proximal end located on the cylindrical body and configured for a user to inhale from;

one or more air vents on one or more adjacent sides of the cylindrical body allowing for air diffusion from ambient air outside of the cylindrical body to the interior chamber, wherein the air vents increase the air flow when the simulator is in use and dilute vapor concentration from the cartridge;

a disposable, replaceable cartridge insertable into a recessed cavity of the main tubing in the interior chamber of a distal end of the cylindrical body, wherein the cartridge is consisting of component constituents and the component constituents do not have any nicotine; and wherein the cartridge is in direct and continuous fluid communication with the one or more air vents when the cartridge is inserted into the recessed cavity of the main tubing; a cover, wherein the cover is attached to the cartridge and coupled to a removably attachable coupling mechanism securing the cartridge in place in the recessed cavity of the main tubing at the distal end of the cylindrical body; and wherein the one or more air vents are angled toward the proximal end and away from the distal end such that air flow is directed from an exterior of the cylindrical body and toward the proximal end in order to draw air from the cartridge toward the distal end when the distal end is inhaled from.

5. The system of claim 1, further comprising:

wherein the one or more air vents are angled such that the flow of air from outside of the apparatus to the inside of the apparatus is angled towards the proximal end of the apparatus.

6. The system of claim 1 where the component constituents further comprise a base, spinach, ginger, cranberry extracts, carrot, pomegranate, citrus extract, broccoli, wheat germ and kale.

7. The system of claim 6, wherein the base comprises a highly concentrated menthol compound.

8. The system of claim 4 where the component constituents comprise a base, spinach, ginger, cranberry extracts, carrot, pomegranate, citrus extract, broccoli, wheat germ and kale.

9. The system of claim 8, wherein the base comprises a highly concentrated menthol compound.

* * * * *